US010260815B2

(12) United States Patent
Hu et al.

(10) Patent No.: US 10,260,815 B2
(45) Date of Patent: Apr. 16, 2019

(54) LANCE AND MULTI-FLUID LANCE DEVICE EQUIPPED WITH THE SAME

(71) Applicant: CHINA ENFI ENGINEERING CORPORATION, Beijing (CN)

(72) Inventors: Liqiong Hu, Beijing (CN); Zhenmin Zhang, Beijing (CN); Rangxian Zhu, Beijing (CN); Linsheng Wang, Beijing (CN); Dong Li, Beijing (CN); Yi Lin, Beijing (CN); Shuangjie Feng, Beijing (CN)

(73) Assignee: CHINA ENFI ENGINEERING CORPORATION, Beijing (CN)

( * ) Notice: Subject to any disclaimer, the term of this patent is extended or adjusted under 35 U.S.C. 154(b) by 238 days.

(21) Appl. No.: 15/383,420

(22) Filed: Dec. 19, 2016

(65) Prior Publication Data

US 2018/0172352 A1 Jun. 21, 2018

(51) Int. Cl.
*F27D 3/16* (2006.01)

(52) U.S. Cl.
CPC ..... *F27D 3/16* (2013.01); *F27D 2003/169* (2013.01)

(58) Field of Classification Search
CPC ..... F27D 2003/168; F27D 2003/169
USPC ..... 266/225
See application file for complete search history.

(56) References Cited

U.S. PATENT DOCUMENTS 6,558,614 B1 * 5/2003 Fritz ..... C21C 5/4606 266/225
2014/0327194 A1 * 11/2014 Matusewicz ..... C21C 5/4613 266/225
2018/0094857 A1 * 4/2018 Li ..... F27D 3/16
2018/0172352 A1 * 6/2018 Hu ..... F27D 3/16

* cited by examiner

*Primary Examiner* — Scott R Kastler
(74) *Attorney, Agent, or Firm* — Hodgson Russ LLP

(57) ABSTRACT

The present disclosure discloses a lance, including a lance head having: a first tube; a second tube, in which the first tube is fitted over the second one; and a through hole tube, in which the through-hole tube has a plurality of axial through holes, a second channel is defined by the first tube, the second tube and the through hole tube, and a first channel is defined by an inner cavity of the second tube and the plurality of axial through holes; an air inlet tube in fluid communication with the second channel; and an air inlet seat connecting with the second tube and having an air inlet channel which is in fluid communication with the first channel. The lance according to the present disclosure can spray uniform gas and can reduce energy consumption. The present disclosure also discloses a multi-fluid lance device equipped with the lance.

17 Claims, 3 Drawing Sheets

LANCE AND MULTI-FLUID LANCE DEVICE EQUIPPED WITH THE SAME

FIELD

The present disclosure relates to smelting field, and particularly to a lance and a multi-fluid lance device equipped with the same.

BACKGROUND

The lance head of a traditional lance used for an oxygen bottom blowing copper smelting furnace has an outer tube, an inner tube and a multi-layer tube. The outer tube is fitted over the inner tube, and a fluid outlet end of the lance head in the inner tube is fitted over a multi-layer tube. The peripheral wall of each layer of the multi-layer tube has several grooves spaced apart along a circumferential direction and in communication along a longitudinal direction, so that an outer channel is formed between outer and inner tubes, while inner channels are formed by an inner channel's cavity and grooves in each layer of the multi-layer tube.

The above-mentioned traditional lance head is made by fitting a tube over another one, so the concentricity of tubes cannot be guaranteed, leading to nonuniform areas of air channels and uneven air spraying which may affect the spraying. In addition, since the gas is distributed at an end away from the lance head, the resistance will be rather large and the loss of gas supply pressure is also large, so energy consumption increases.

SUMMARY

The present disclosure aims to solve at least one of the existing technical problems existing in the art.

Therefore, one of the purposes of the present disclosure is to put forward a lance that can spray uniform fluid with less energy consumption.

Another purpose is to put forward a multi-fluid lance device which can evenly spray a plurality of fluids at the same time with less energy consumption.

The lance according to the first aspect of the present disclosure includes a lance head having: a first tube; a second tube, in which the first tube is fitted over the second one, and a preset distance is provided between a first end of the first tube and a first end of the second tube; and a through hole tube, in which the through-hole tube has a plurality of axial through holes, a second end of the through hole tube is coaxially connected to the first end of the second tube, the through hole tube is located between the first end of the first tube and the second end of the second tube, a second channel is defined by the first tube, the second tube and the through hole tube, and a first channel is defined by an inner cavity of the second tube and the plurality of axial through holes; an air inlet tube in fluid communication with the second channel to feed a second fluid into the second channel; and an air inlet seat connecting with the second tube and having an air inlet channel which is in fluid communication with the first channel to feed the first fluid into the first channel.

The through hole tube has the plurality of axial through holes, which avoids the defect of traditional lances that the tube concentricity cannot be guaranteed and makes areas of channels where the first fluid passes even, and the lance according to the embodiment of the present disclosure can spray uniform gases. In addition, the first fluid is distributed in the through hole tube instead of earlier distribution during spraying, which reduces the flow resistance, so the gas supply pressure can be reduced and so does energy consumption, and the lance service life can be prolonged.

In addition, the lance according to the present disclosure also has the following additional technical features:

The first tube, the second tube and the through hole tube are coaxial, which can guarantee uniform spraying.

The length of the above-mentioned through hole tube is 100-800 mm.

The above-mentioned first tube, the second tube and the through hole tube have circular cross sections.

A plurality of grooves extending along the whole length of the through hole tube in an axial direction and spaced apart in a circumferential direction is provided in an peripheral wall of the through hole tube.

A cross section of each groove is in the shape of a substantially rectangle or a semicircle.

Optionally, the grooves in the lance are evenly distributed along the circumferential direction. These grooves can make the second fluid uniformly sprayed in a dispersion state.

The plurality of axial through holes in the through hole tube includes a central through hole and a plurality of outer circumferential through holes around the central hole.

Optionally, the above-mentioned outer circumferential through holes are distributed in a plurality of concentric circles, and the outer holes in each concentric circle are evenly distributed along the circumferential direction.

Further optionally, these concentric circles are evenly distributed along the radial direction.

The lance according to the embodiment of the present disclosure uniformly sprays the first and second fluid with good blending effect. In addition, after individually machining, the second tube and the through hole tube are connected together instead of integral formation, so if the through hole tube is worn after use for some time, it's only need to replace the through hole tube, which reduces the cost.

The cross sectional area of the air inlet channel in the above-mentioned air inlet seat becomes smaller and smaller gradually from the air inlet seat's second end to first end which connects with a second end of the second tube, which will reduce gas flow loss of the second fluid when entering into this air inlet channel.

Optionally, the above-mentioned air inlet channel and the first channel are coaxial.

The lance further includes an inlet box connected with the first end of the air inlet seat and having an air cavity therein, and the air cavity makes the air inlet tube and the second channel in communication. The wind cavity is provided between the air inlet tube and the second channel, which will make the first fluid distributed evenly in it before entering into the second channel and evenly sprayed out of the lance.

Optionally, the above-mentioned second end of the second tube and the first end of the air inlet seat are connected through threaded connection, and a first end of the inlet box is fitted over a second end of the first tube through threaded connection, and the air inlet tube is connected with the inlet box outer wall.

The above-mentioned lance further includes a positioning device, which includes: a fixing frame fitted over the first tube of the lance head and suitable to be fixed on a smelting furnace body; a ferrule installed between the fixing frame and the first tube and fixed to the fixing frame; and a puller bolt passing through the ferrule and abutting against the first tube to fix the lance on the smelting furnace body through.

The lance head according to the embodiment of the present disclosure can be moved along the axial direction by providing the positioning device. When the a end of the lance head is worn, the puller bolt can be loosened and the lance head can be moved towards the first end at a predetermined length along the axial direction to compensate for losses other than replacing it, which saves costs and reduces waste.

The multi-fluid lance device according to the second aspect of the present disclosure includes the lance made according to the first aspect; and a third fluid tube in fluid communication with the second channel fluid to feed a third fluid into the second channel.

The multi-fluid lance device according to the embodiment of the present disclosure can simultaneously spray out various fluids, which can be used for smelting needing various fluids.

Additional aspects and advantages of the present disclosure will be partially described in the below, and a part will become obvious from the below description, or will be understood by the practice of the present disclosure.

BRIEF DESCRIPTION OF THE DRAWINGS

The above and/or additional aspects and advantages of the present disclosure will become obvious or will be understood from the description of example of below attached drawing, where.

REFERENCE SIGNS

Figure 1:
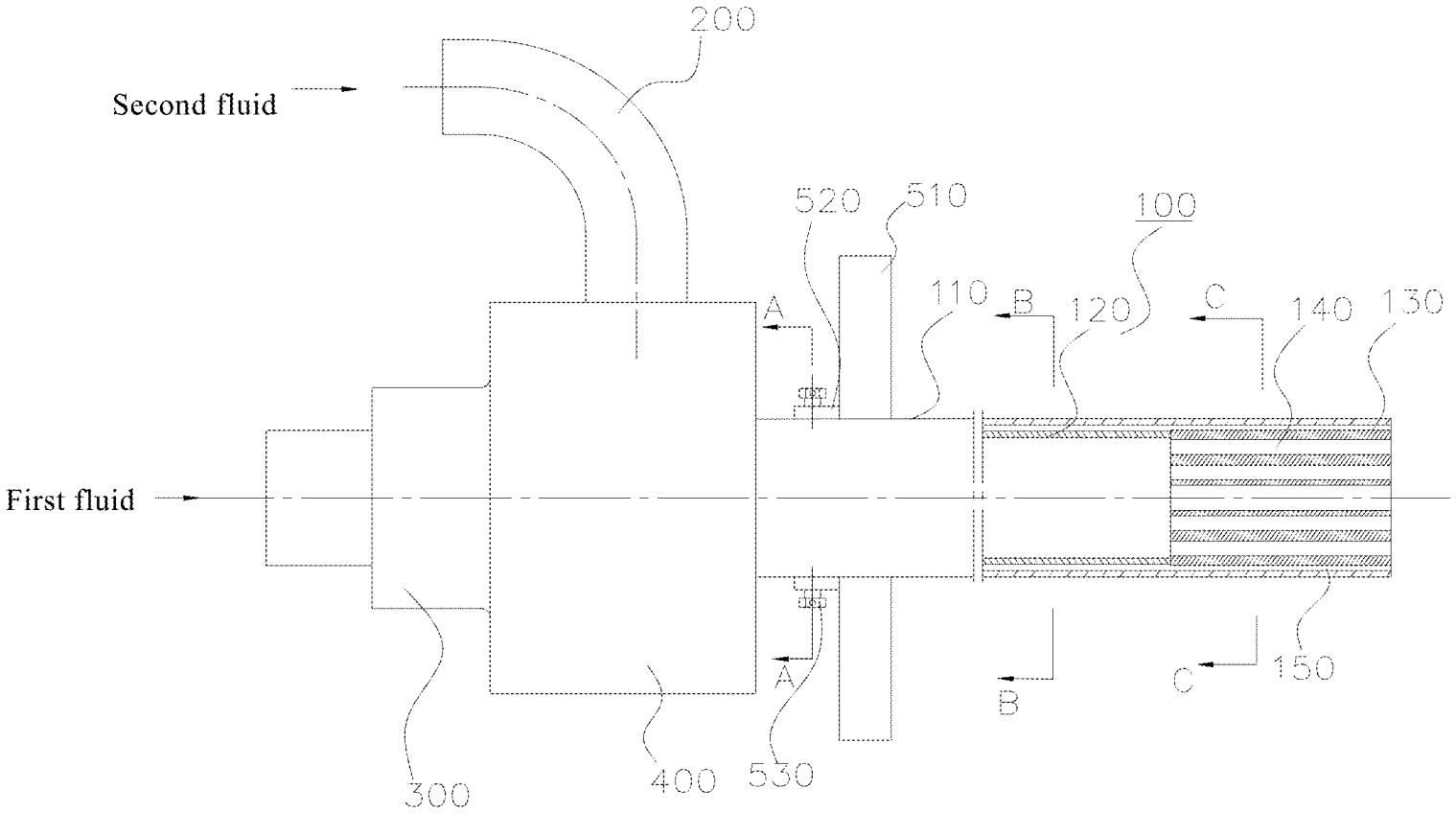
FIG. 1 is a sectional view of a lance according to an embodiment of the present disclosure, and the lance sprays a first fluid and a second fluid.

100 Lance head;

110 First tube; 120 Second tube; 130 Through hole tube;

132 Grooves; 1311 Central through hole; 1312 Outer circumferential through holes;

140 First channel; 150 Second channel;

200 Air inlet tube; 300 Air inlet seat;

400 Inlet box; 500 Positioning device;

510 Fixing frame; 520 Ferrule; 530 Puller bolt;

600 Third fluid tube.

DETAILED DESCRIPTION

The embodiment of the present disclosure will be described below in detail, whose examples are shown in attached drawings. The marked numbers which are totally the same or similar represents the same or similar element or the element with same or similar function. The following embodiments in attached drawings are examples which just be used for explaining the present disclosure but cannot be understood as a restriction of the present disclosure.

In the description for the present disclosure, the terms of "inner", "outer", "up", "down, "top", and "bottom" and other indicated orientations or positional relations are based on the orientations or positional relations shown in attached drawings, which are just for the convenience of describing the present disclosure and simplifying description instead of mean or hint the indicated device or element must have the specific orientation, or specific structure and operation of orientation, thus it shall not be understood as a restriction of the present disclosure.

With reference to FIGS. 1-4, the lance according to an embodiment of the present disclosure will be described below.

A lance includes a lance head 100, an air inlet tube 200 and an air inlet seat 300. As shown in FIGS. 1-4, the lance head 100 includes a first tube 110, a second tube 120 and a through hole tube 130. The first tube 110, the second tube 120 and the through hole tube 130 in one example of the present disclosure all have a circular cross section.

Figure 2:
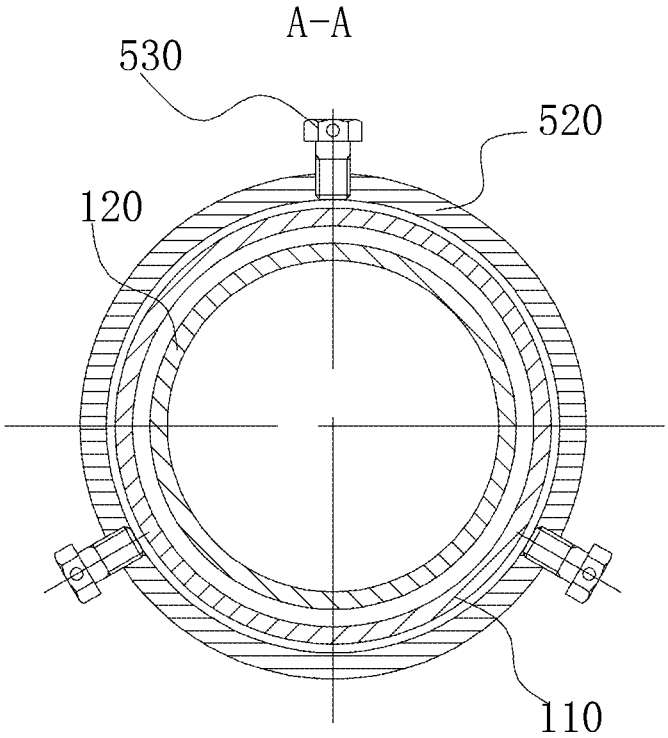
FIG. 2 is a sectional view along line A-A in FIG. 1.
Figure 3:
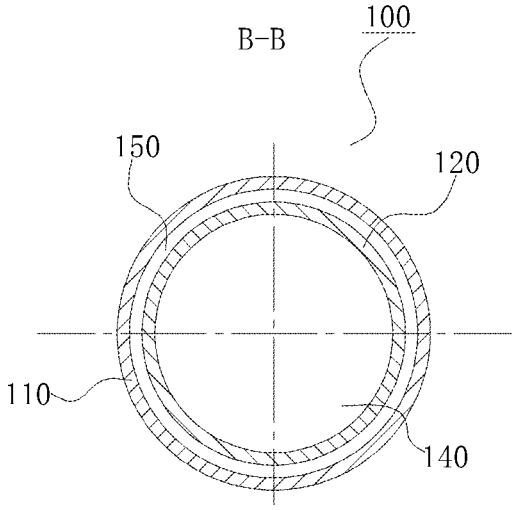
FIG. 3 is a sectional view along line B-B in FIG. 1.

As shown in FIGS. 1-3, the first tube 110 is fitted over the second tube 120, and a preset gap is provided between the first tube 110 and the second tube 120, which means there is a preset clearance between the inner diameter of the first tube 110 and the outer diameter of the second tube 120. Optionally, the first tube 110 is coaxially fitted over the second tube 120 so that the preset gap between the first tube 110 and the second tube 120 can be uniform along axial and circumferential directions.

Both the first tube and the second tube have a first end (a right end shown in FIG. 1) and a second end (a left end shown in FIG. 1). The first end of the second tube 120 is apart from the first end of the first tube 110 at a preset distance, which is 100-800 mm in one example of the present disclosure.

The through hole tube 130 has a plurality of axial through holes, and also has a first end (a right end shown in FIG. 1) and a second end (a left end shown in FIG. 1). The second end of the through hole tube 130 is coaxially connected with the first end of the second tube 120 by means of welding for instance. The through hole tube 130 is located between the first end of the second tube 120 and the first end of the first tube 110, which means that the length of the though hole tube 130 is 100-800 mm.

In one of embodiments of the present disclosure, the outer diameter of the though hole tube 130 is less than the inner diameter of first tube 110, thus a preset annular gap can be formed between the first tube 110 and the through hole tube 130. Optionally, the first end of the through hole tube 130 is flush with the first end of the first tube 110. Further optionally, the first tube 110, the second tube 120 and the through hole tube 130 are coaxial, which makes a radial dimension of the preset gap between the first tube 110 and the second tube 120 the same as that between the first tube 110 and the though hole tube 130.

A second channel 150 is defined by the preset gap between the first tube 110 and the second tube 120, and the preset gap between the first tube 110 and the through hole tube 130, so that a second fluid flows from the second end to the first end along the second channel 150. A first channel 140 is defined by an inner cavity of the second tube 120 and the plurality of axial through holes, the first fluid flows from the second end to the first end along the first channel 140.

In another embodiment of the present disclosure, a tolerance fit is provided between the through hole tube 130 and the first tube 110, but the present disclosure is not limited to this. For this purpose, the through hole tube 130 has a plurality of grooves 132 spaced apart along a circumferential direction in a peripheral wall thereof to allow the second fluid to flow, and the plurality of grooves extends along the axial direction through the whole length of the through hole tube 130. Preferably, the outer diameter of the through hole tube 130 may be substantially the same as the inner diameter of the first tube 110. In this way, opening of the grooves 132 may be closed by an internal circumferential wall of the first tube 110, so that the preset gap between the through hole tube 130 and the first tube 110 is divided in to a plurality of sub-channels defined by the plurality of grooves 132 in the circumferential direction. Therefore, the second channel 150 is defined by the plurality of grooves 132, the first tube 110, and the second tube 120, which is shown in FIG. 1. The sub-channels defined by the preset gap between through hole tube 130 and first tube 110 can make the second fluid more dispersive in spraying by the grooves 132 after the second fluid reaches the lance head through the preset gap between the first tube 110 and the second tube 120, which can further improve the spray effect of the second fluid.

Optionally, the grooves 132 in the through hole tube 130 are evenly distributed along the circumferential direction, which will guarantee the uniform spraying of the second fluid when the second fluid is sprayed from the lance head.

Figure 4:
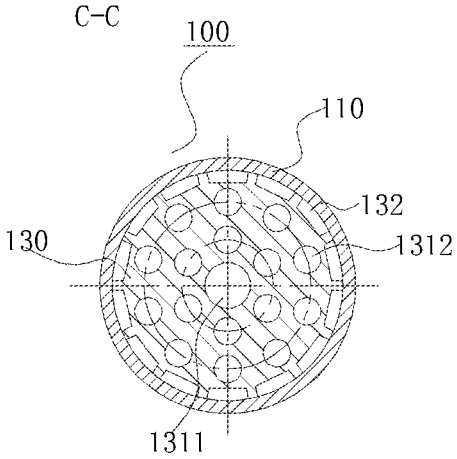
FIG. 4 is a sectional view along line C-C in FIG. 1.

In one of examples of the present disclosure, the cross section of each groove 132 is in the shape of a substantially rectangle as shown in FIG. 4. In another example of the present disclosure, the cross section of each groove 132 is in the shape of a semicircle. However, the present disclosure is not limited to these conditions. The cross section of each groove 132 may have any shape as long as the second fluid can be sprayed out from a first end of the lance through gaps between the grooves 132 and the first tube 110. Furthermore, the size of each groove 132 can be adjusted according to specific applications.

In one embodiment of the present disclosure, the plurality of axial through holes of the through hole tube 130 contains a central through hole 1311 and a plurality of outer circumferential through holes 1312 around the central hole 1311, which are shown in FIGS. 1 and 4. These outer circumferential through holes 1312 are distributed in a plurality of concentric circles, the outer circumferential through holes 1312 in each concentric circle are evenly distributed along the circumferential direction, and optionally, the plurality of concentric circles are uniformly distributed along the radial direction. Above arrangement can make the first fluid flow along the first channel 140 from the second end (the left end shown in FIG. 1) to the first end (the right end shown in FIG. 1) and sprayed out from the lance with uniform pressure and mixing with the second fluid.

Optionally, the first tube and the second tube are made of stainless steel, and the through hole tube is made of heat-resistance stainless steel.

The through hole tube has the plurality of axial through holes, which avoids the defect of traditional lances that the tube concentricity cannot be guaranteed and makes areas of channels where the first fluid passes even, and the lance according to the embodiment of the present disclosure can spray uniform gases. After individually machining, the through hole tube is connected with the second tube, so if the through hole tube is worn after use for some time, it's only need to replace the through hole tube, which can reduce the cost. In addition, the first fluid is distributed in the through hole tube instead of earlier distribution during spraying, which reduces the flow resistance, so the gas supply pressure can be reduced and so does energy consumption, and the lance head service life can be prolonged. And the first fluid and the second fluid are uniformly sprayed with good blending effect.

As shown in FIGS. 1-4, in the lance according to embodiments of the present disclosure, the air inlet tube 200 is in fluid communication with the second channel 150 of so as to feed the second fluid into the second channel. In one example of the present disclosure, the lance further contains an inlet box 400 connecting with a first end of the air inlet seat 300 and having a wind cavity (not shown in the drawings) therein. The wind cavity makes the air inlet tube 200 and the second channel 150 in communication with each other. For example, the first end of the inlet box 400 may be fitted over the second end of the first tube 110 by threaded connection, and the air inlet tube 200 is connected to an outer wall of the inlet box 400, which are shown in FIG. 1. The wind cavity is disposed between the air inlet tube 200 and the second channel 150, which will make the first fluid distributed evenly in the wind cavity before entering the second channel 150 and evenly sprayed out from the lance.

The air inlet seat 300 connects with the second tube 120, and there is an air inlet channel (not shown in the drawings) in a second end of the air inlet seat 300. The air inlet channel is in fluid communication with the first channel 140 to provide the first channel 140 with the first fluid. Specifically, the first end of the air inlet seat 300 is connected to the second end of the second tube 120, for example, in threaded connection. Optionally, the air inlet channel and the first channel 140 are coaxial. In one example of the present disclosure, the cross-sectional area of the air inlet channel of the air inlet seat 300 becomes smaller and smaller gradually (not shown in the drawings) from the second end to the first end of air inlet seat 300, so as to reduce the gas flow loss when the second fluid entering the air inlet channel.

In another embodiment of the present disclosure, the lance also contains a positioning device 500 for fixing the lance on a smelting furnace body, such as on a bottom blowing furnace.

As shown in FIG. 1, the positioning device includes a fixing frame 510, a ferrule 520 and a puller bolt 530. The fixing frame 510 is fitted over the first tube 110 of the lance head 100 and suitable for being fixed on a smelting furnace body, such as a bottom blowing furnace body. In one example of the present disclosure, there is a plurality of through holes uniformly distributed in the fixing frame 510, so that the fixing frame 510 is fixed on the furnace with bolts. The ferrule 520 is disposed between the fixing frame 510 and the first tube 110 and fixed to the fixing frame 510. For example, an axial central hole is formed in the center of fixing frame 510 to fit over the first tube 110, and the ferrule 520 is welded to the periphery of the central hole and protrudes from the fixing frame along axial direction. There is a plurality of through holes uniformly distributed in a portion protruding from the fixing frame of ferrule 520 along the circumferential direction. So the puller bolt 530 can pass through ferrule 520 and abut against the first tube 110, thereby fixing the spray gun on the bottom blowing furnace body.

According to the embodiment of the present disclosure, the lance head 100 can be moved along the axial direction by disposing the positioning device 500. When a first end of the lance head 100 (i.e. a right end in the FIG.) is worn, the puller bolt 530 can be loosened and the lance head 100 can be moved towards the first end at a predetermined length along the axial direction to compensate for losses other than replacing it, which saves costs and reduces waste.

Next we will refer to FIGS. 1-4 to describe flow modes of fluid in the lance according to embodiments of the present disclosure. In the following description, an oxygen lance used in an oxygen bottom blowing copper smelting furnace is taken as an example, where the first fluid is oxygen, and the second fluid is air.

The air enters inlet box 400 from the air inlet tube 200 and evenly distributes in the wind cavity, and then enters the second channel 150. Specifically, the air is uniformly sprayed from the lance in a dispersion state through the clearance between the first tube 110 and the second tube 120 and the plurality of grooves axially and evenly distributed along the through hole tube 130. The oxygen enters the first channel 140 from the inlet channel of the air inlet seat 300. Specifically, the oxygen is sprayed out of the lance through the plurality of axial through holes of the through hole tube 130 after entering the second tube 120.

As mentioned above, since the length of the through hole tube is short, the oxygen will not be distributed prematurely leading to pressure loss, which will improve the smelting effect. Moreover, the air spraying effect is further improved by a dispersion way along grooves, and the area contracting with the melt is wide, and the stirring effect is better, which will improve the smelting effect.

Referring to FIGS. 1-5, a multi-fluid lance according to the embodiment of the present disclosure will be described below.

Figure 5:
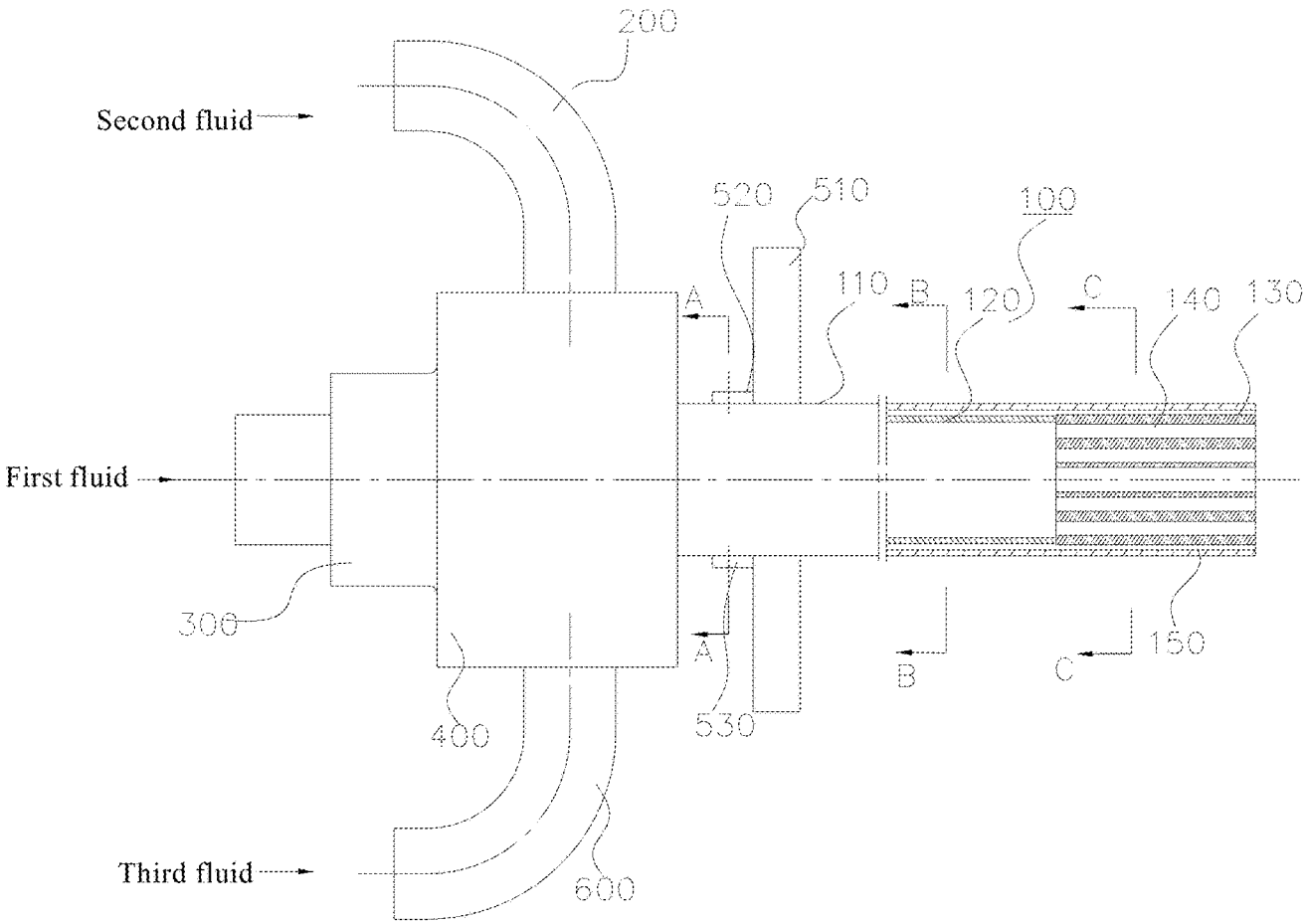
FIG. 5 is a sectional view of a multi-fluid lance device according to an embodiment of the present disclosure.

The multi-fluid lance device according to the embodiment of the present disclosure as shown in FIG. 5 includes a lance and a third fluid tube 600, the lance is any one described in above embodiment. The third fluid tube 600 is in fluid communication with the second channel 150 of the lance to transport the third fluid into the second channel 150. And after entering the second channel 150, the third fluid will mix with the second fluid evenly, and then will be sprayed out of the lance from the first end of the second channel 150. For example, the third fluid tube 600 is connected to an outer lateral wall of inlet box 400 to be in fluid communication with the wind cavity. The second fluid from the air inlet tube 200 and the third fluid from the third fluid tube 600 entering the wind cavity will be mixed evenly, and then will be sprayed out of lance through the second channel 150.

The multi-fluid lance device according to the embodiment of the present disclosure can simultaneously spray out various fluids, so as to be used for smelting needing various fluids. Those skilled in the art can understand that the third fluid described in the present disclosure is not limited to one kind of fluid, which may include a variety of fluids respectively entering the second channel such as nitrogen, water and other fluids. Accordingly, the third fluid tube is not only limited to one tube. When the third fluid includes a plurality of fluids, the third fluid tube may also include a plurality of lines respectively communicated with the second channel to respectively transport the plurality of fluids into the second channel.

Next we will refer to FIGS. 1-5 to describe flow modes of fluid flow in the multi-fluid lance device according to the embodiment. In the following description, the oxygen lance used in oxygen bottom blowing lead smelting furnace is taken as an example, the first fluid is oxygen, the second fluid is air, and the third fluid is water.

As shown in FIG. 5, the air enters the inlet box 400 from the air inlet tube 200, and at the same time water enters the inlet box 400 from the third fluid tube 600. After being evenly mixed in the wind cavity, the water and air enter the second channel 150. Specifically, the air is uniformly sprayed from the lance in a dispersion state through the clearance between the first tube 110 and the second tube 120 and the plurality of grooves axially and evenly distributed along the through hole tube 130. At the same time, the oxygen enters the first channel 140 from the inlet channel of the air inlet seat 300 and is sprayed outside. Specifically, the oxygen is sprayed out of the lance through the plurality of axial through holes of the through hole tube 130 after entering the second tube 120.

As mentioned above, the oxygen will not be distributed prematurely leading to the pressure loss, which will improve the smelting effect. Moreover, the air and water spraying effect is further improved through spraying them in a dispersion way along grooves, and the area contracting with the melt is wide, and the stirring effect is better, which will improve the smelting effect.

In the Specification, the reference terms of "an embodiment", "some embodiments", "schematic example", "example", "specific example" or "any examples" refer to combining with examples or the described specific characteristic, structure or feature of examples are contained in at least one example or exploit example of the present disclosure. In the Specification, the schematic expression of above terms not always means the same example or exploit example And the described specific characteristic, structure or feature can be combined with in one or any examples or exploit examples by a proper way.

The embodiments of the present disclosure have been shown and described, and common technical personnel in this field can understand: these embodiments can be changed, modified, replaced and deformed under the principles and purposes of the present disclosure, and the scope of the present disclosure is determined by patent claims and the equivalents.

What is claimed is:

1. A lance, comprising:

a lance head having:

a first tube;

a second tube, wherein the first tube is fitted over the second tube, and a preset distance is provided between a first end of the first tube and a first end of the second tube; and a through hole tube, wherein the through hole tube has a plurality of axially extending through holes, a second end of the through hole tube is coaxially end-to-end connected to the first end of the second tube, the through hole tube is located between the first end of the first tube and the first end of the second tube, a second channel is defined by the first tube, the second tube and the through hole tube, and a first channel is defined by an inner cavity of the second tube and the plurality of axially extending through holes;

an air inlet tube in fluid communication with the second channel to feed a second fluid into the second channel;

an air inlet seat connected with the second tube and having an air inlet channel which is in fluid communication with the first channel to feed a first fluid into the first channel; and a positioning device, wherein the positioning device comprises:

a fixing frame fitted over the first tube of the lance head and suitable to be fixed on a smelting furnace body;

a ferrule installed between the fixing frame and the first tube and fixed to the fixing frame; and a puller bolt passing through the ferrule and abutting against the first tube to fix the lance on the smelting furnace body.

2. The lance according to claim 1, wherein the first tube, the second tube and the through hole tube are coaxial.

3. The lance according to claim 2, wherein a length of the through hole tube is 100-800 mm.

4. The lance according to claim 1, wherein the first tube, the second tube and the through hole tube have circular cross sections.

5. The lance according to claim 2, wherein the first tube, the second tube and the through hole tube have circular cross sections.

6. The lance according to claim 3, wherein the first tube, the second tube and the through hole tube have circular cross sections.

7. The lance according to claim 4, wherein a plurality of grooves extending along the whole length of the through hole tube in an axial direction and spaced apart in a circumferential direction is provided in an peripheral wall of the through hole tube.

8. The lance according to claim 7, wherein a cross section of each groove is in the shape of a substantially rectangle or a semicircle.

9. The lance according to claim 7, wherein the plurality of grooves in the lance is evenly distributed along a circumferential direction.

10. The lance according to claim 4, wherein the plurality of axially extending through holes in the through hole tube comprises a central through hole and a plurality of outer circumferential through holes around the central hole.

11. The lance according to claim 10, wherein the plurality of outer circumferential through holes is distributed in a plurality of concentric circles, and the outer holes in each concentric circle are evenly distributed along a circumferential direction.

12. The lance according to claim 11, wherein the plurality of concentric circles is evenly distributed along a radial direction.

13. The lance according to claim 1, wherein a cross sectional area of the air inlet channel in the air inlet seat becomes smaller and smaller gradually from a second end to a first end of the air inlet seat, and the first end of the air inlet seat is connected to the second end of the second tube.

14. The lance according to claim 13, wherein the air inlet channel and the first channel are coaxial.

15. The lance according to claim 13, further comprising an inlet box connected with the first end of the air inlet seat and having an air cavity therein, and the air cavity makes the air inlet tube and the second channel in communication.

16. The lance according to claim 15, wherein the second end of the second tube is connected to the first end of the air inlet seat through threaded connection, and a first end of the inlet box is fitted over a second end of the first tube through threaded connection, and the air inlet tube is connected to an outer wall of the inlet box.

17. A multi-fluid lance device, comprising:

a lance, comprising a lance head having:

a first tube, a second tube, wherein the first tube is fitted over the second tube, and a preset distance is provided between a first end of the first tube and a first end of the second tube, and a through hole tube, wherein the through hole tube has a plurality of axially extending through holes, a second end of the through hole tube is coaxially end-to-end connected to the first end of the second tube, the through hole tube is located between the first end of the first tube and the first end of the second tube, a second channel is defined by the first tube, the second tube and the through hole tube, and a first channel is defined by an inner cavity of the second tube and the plurality of axially extending through holes, an air inlet tube in fluid communication with the second channel to feed a second fluid into the second channel;

an air inlet seat connected with the second tube and having an air inlet channel which is in fluid communication with the first channel to feed a first fluid into the first channel;

a positioning device, wherein the positioning device comprises:

a fixing frame fitted over the first tube of the lance head and suitable to be fixed on a smelting furnace body;

a ferrule installed between the fixing frame and the first tube and fixed to the fixing frame; and a puller bolt passing through the ferrule and abutting against the first tube to fix the lance on the smelting furnace body; and a third fluid tube in fluid communication with the second channel fluid to feed a third fluid into the second channel.

* * * * *